US005140538A

United States Patent [19]

Bass et al.

[11] Patent Number: 5,140,538

[45] Date of Patent: Aug. 18, 1992

[54] HYBRID DIGITAL-ANALOG COMPUTER PARALLEL PROCESSOR

[75] Inventors: J. E. Bass, Rogers; Randy L. Brown, Fayetteville, both of Ark.

[73] Assignee: University of Arkansas, Little Rock, Ark.

[21] Appl. No.: 290,529

[22] Filed: Dec. 27, 1988

[51] Int. Cl.[5] ..... G06J 1/00; G06G 7/163

[52] U.S. Cl. ..... 364/602; 307/296.6; 307/464; 382/30; 382/33

[58] Field of Search ..... 364/601, 602, 604, 807, 364/819, 820, 513; 307/201, 464, 355, 356, 357, 296.1, 296.5, 296.6, 296.8; 382/14, 15, 30, 33, 34, 35; 323/265, 269, 280, 281

[56] References Cited

U.S. PATENT DOCUMENTS

| | | | |
|---|---|---|---|
| 3,601,811 | 8/1971 | Yoshino | 382/15 X |
| 3,638,196 | 1/1972 | Nishiyama et al. | 364/900 |
| 4,802,103 | 1/1989 | Faggin et al. | 382/15 X |

OTHER PUBLICATIONS

N. Nillson, *Learning Machines*, copyright 1965 by McGraw-Hill, Inc., pp. 95-113.

J. Millman et al., *Microelectronics*, 2nd ed., copyright 1987 by McGraw-Hill, Inc., pp. 150-151.

Raffel, J., "Electronic Implementation of Neuromorphic Systems", *Proc. IEEE 1988 Custom Integrated Circuits Conf.*, May 1988, pp. 10.1.1-10.1.7.

Lippman, R., "An Introduction to Computing with Neural Nets", *IEEE ASSP Magazine*, Apr. 1987, pp. 4-22.

*Primary Examiner*—Stephen M. Baker

*Attorney, Agent, or Firm*—Robert R. Keegan

[57] ABSTRACT

Hybrid digital-analog computer parallel processing apparatus wherein a template circuit, or multiplicity thereof, is connected to receive parallel digital inputs, each template circuit having controlled current sources with control gates connected respectively to parallel digital inputs. Current sub-sources for each pixel normally have programmable current output and "0" or "1" responses. Each template circuit has a current summing device for algebraically adding the current outputs of current sources, while a greatest value is detected at a comparator which may have a ramp signal applied to another input thereby identifying which template produced a maximum indication from the same parallel inputs. A self-calibrating feedback controlled current generator supplies all current sources on a chip making it possible to generate a known comparator input independent of IC resistivity or other parameters. The value of the indication of other templates may also be determined by the time relation of comparator output signals. If templates of the apparatus represent printed character correlation data, the output of the processor would identify the template with maximum indication and character with highest probability from a set of pixel inputs. Similar apparatus can be cascaded to first identify details in a scene and then match such detail charts with second stage templates.

5 Claims, 7 Drawing Sheets

HYBRID DIGITAL-ANALOG COMPUTER PARALLEL PROCESSOR

The present invention relates to computing technology and particularly to special purpose computer apparatus wherein multiple digital inputs are processed for correlation with other data or for other purposes, and in which summing of a multiplicity of addends is carried out by summation of currents with analog electronic computing techniques. Further analog processing of the current sum may be utilized to identify which of a plurality of template circuits produces a maximum indication or to obtain a relative or absolute value of the total current output of particular template circuits.

An important use of apparatus according to the invention may be found in character recognition or pattern identification due to the highly parallel nature of processing correlation data in apparatus according to the invention. Correlation comparisons and hence character recognition operations may be expected to be carried out at one hundred thousand per second rates or better. Enhanced speed of operation is also expected with other computing operations involving correlation, such as found in voice recognition, medical diagnosis expert systems and other expert systems. While problems involving correlation is a very promising field of use for the apparatus of the invention, it is not limited to such applications. Any computing operation that involves the addition of a multiplicity of addends (perhaps fifty to one hundred or more) is a candidate to be benefited by use of apparatus according to the invention.

While apparatus according to the invention could be assembled using discrete components, it is remarkably well suited to large scale integration on high density solid state integrated circuit chips. Using the present capabilities of the very large scale integrated circuit art a single chip may contain essentially an entire complex apparatus for super high speed character recognition. There is a particular advantage to producing such apparatus on a single chip when it involves highly parallel processing since critical interconnection problems may be encountered with multiple chip systems using highly parallel computing techniques.

The templates, summing and recognition circuits of the apparatus, although primarily analog electronic computing circuits, are readily interfaced at both the input and the output to either analog or digital conventional computer processing elements and circuits.

BACKGROUND OF INVENTION

Image processing technology has become a key element in many systems such as robotic vision systems, satellite reconnaisance, OCR, visual inspection systems, and military weapons systems. Most image processing is now performed by digital algorithmic techniques on stored program computers. These techniques are so computationally intensive that, even with today's high-speed technology, many real time requirements can not be successfully met. In cases where there are no other alternatives, dedicated, highly parallel, special purpose digital techniques can be employed but the size and cost of such systems preclude their use in most applications. An important application of the present invention provides a high-speed, low cost, small size component which will provide good performance in practical image and pattern matching applications. Rapidly advancing, high performance analog semiconductor technology provides a viable alternative to digital processing techniques since high precision answers are not required in pattern matching applications. Usually the question to be answered is "which is the closest match in the finite ensemble of alternatives possible".

One specific embodiment of this invention provides a parallel hybrid analog-digital image processing device which will provide substantial improvement in image processing speeds (100 times) and implementation size and costs (10 times) over known digital techniques. The apparatus uses analog network techniques to calculate auto-correlation and cross-correlation functions in a highly parallel, hybrid analog-digital configuration.

The basic concept of the invention is generic in form and is amenable to many application-specific designs for different purposes, the Optical Character Recognition (OCR) application is only one. The inherent capability of the device to make a best match in the presence of inexact, incomplete or erroneous data opens many opportunities in decision-making situations in which the data cannot be expected to be perfect or complete. In the OCR application, input data is from a graphic source, but other data can be used from audio sources, radio frequency sources or a wide variety of other data categories.

Systems according to the invention lend themselves to translation of high level system concepts and functions directly into silicon designs. Because of the complexities and costs of large software based systems, as well as their inability to perform in real time, there is a trend toward more application-specific designs such as those provided by the present invention (which uses no software yet performs a very complex task); this direct system-to-silicon capability is very important in practical implementation of parallel computation techniques.

The device proposed may be classified as a member of the termed "connectionist" systems. Closely related to neural networks, the basic philosophy of a connectionist system is to provide the total knowledge base inherent in a system in a singular, simultaneous, and focused manner to the parallel input signal to be processed. The knowledge of a connectionist system is inherent in the device connections and weighting functions; the input image is applied directly and simultaneously to all elements of the system and directly controls the functions of those elements. The knowledge base of a digital system, in comparison, is contained in the software and the input signal must be stored in memory to await sequential (albeit somewhat parallel) processing by the software.

A system according to the invention is a hybrid which borrows from several related technology areas (parallel processing, neural networks, combined analog/digital functions, and connectionist systems) but does not exactly fit any of these. The distributed digital storage of cell weights in each cell relates to the parallel distributed memory concepts and also provides a convenient interface between the digital and analog worlds. The current summation techniques used internal to the cells and array of cells, the weighted inputs, and the firing of the highest charged correlation capacitor are closely related to neural network technology in its purest form, yet we do not consider essential the self-organizing or self-learning activities which are the center of the universe for the pure neural network technologists. Similarly, the knowledge of the system is based on interconnections and weights of the interconnections; hence the total knowledge base of the system is available simultaneously to interact with the total input image; these are characteristics of a connectionist system.

The elegant simplicity of devices according to the invention derives from combining the best techniques from the three associated areas in a unique fashion while avoiding the issues (primarily generality, universality, trainability, massive interconnection arrays, or exact modeling of human neurons) which have slowed progress in the respective fields and which are the subjects of most of the published literature. While theoretical research is desirable, the advantages of the invention lie in shorter term, application-specific techniques to solve current problems. The literature (See Appendix A hereinafter) provides a wealth of information in the three various areas discussed but does not reveal any activities, per se, into the type of system function and applications described here. None, for example, are specifically concerned about the speed, or bandwidth of their neural network circuit, they are typically modeled after human neurons and by design operate at about a 100 cycle per second rate; in accordance with the invention "neural" functions preferably occur at a 100,000 to 1,000,000 cycles per second rate. A brief summary of the traditional fields of parallel processing, neural networks, and connectionist systems and mainline efforts in each area is given below.

Research in parallel processing of interest is primarily directed at large arrays (>10,000) of small, simple, stored program digital computing elements, some of which may be only one bit word length. The problems to be solved in this area of research are (1) the complexity of partitioning the problems in a balanced manner to fit the array processor characteristics; (2) software structuring to fit the problem/array processor structuring; and (3) inter-processor and inter-task communications. Typical of this area is the Connection machine, Reference (17). These types of digital architectures appear to be limited to specific classes of problems; they are now very application-limited and do not appear to be appropriate to broad classes of computing problems. The basic problem is that many of the difficult information processing problems are far too complex to readily be programmed by algorithmic means for multipurpose computers; additionally, total software experience is based on that approach and may not be appropriate for direct conversion to fit any general array or parallel processing characteristics. The situation may lead to a large number of problem-specific digital organizations typical of the present approach. The inadequacy of conventional computer systems for visual processing applications is documented in References (12), (13), (14), and (15).

Research in neural network technology is focused primarily in the areas of self-organization of large arrays of elements and in the techniques of iterative learning processes to reach optimum performance levels. Most research has been of such broad scope and so general that the difficulty of the problems studied distracts from the development of the elements themselves. An exception to this approach is the work of Hopfield and Tank, References (9)–(12), (18), who confine their scope to simpler problems, and are actively modeling analog neural networks for implementation in silicon form.

Their approach is to build an analog circuit described by the set of coupled non-linear differential equations they think describes the human neural network, so they are trying to duplicate as closely as possible the human brain equivalent. The question to be answered is whether the exact single neuron model is appropriate in small, microscopic applications such as we can put together compared to the real working environment of a human neuron, i.e. millions of neighbors and thousands of extremely complex interconnections, all of unknown significance at this time. In our understanding a related reservation as to "neural network" technology is whether the exact functional duplication is necessarily the best approach for important current problems, i.e. airplanes don't flap their wings to fly like birds do.

Hopfield and Tank have simulated and built, based on their model, a simple 4-bit analog to digital converter which converts analog inputs to digital codes. In addition, they have built a 900 element simulation model which solves the classic traveling salesman problem for a 30 city route. Settling time for this neural array was simulated to be 0.1 second. They calculated that to solve the same problem with conventional digital algorithms in the same 0.1 second would require about 10,000 times the amount of hardware required for their neural implementation. Fukushima, Reference (19), describes a numeric character recognition unit using multi-layer neural networks which derive features from the image; his predicted performance is roughly comparable to conventional techniques.

Several small scale neural networks of 20 to 30 neurons have been fabricated on a silicon die and demonstrate the basic practicality of IC implementation of hybrid analog-digital systems. See References (13), (18). These prior applications were primarily associative memory oriented in which an input word is applied to a group of stored words and the stored word which most closely resembles the input word is fetched from the memory without requiring physical addressing of the memory array.

The leading proponents of connectionist systems are the cognitive scientists who, in simulating complex behaviors of several hundred milli-seconds duration (representing about 100 processing cycles for neurons), have found that present day simulation programs require millions of steps to emulate those neural functions. There is a feeling that the digital computer as we know it today has, in effect, reached its limit for cognition problems. The Von Neumann computer, in essence, was designed to compute numbers and it is being realized now that this is not necessarily a good, or even a mediocre, solution in addressing higher level cognition and perception problems. Conventional computers were used in initial works because they were the tools most readily available. That use demonstrated the limitations of the stored program concept compared to the massively parallel or neural network functions being simulated and led to the connectionist movement. One fundamental premise of connectionism is that individual neurons do not transmit large amounts of symbolic information; instead, they compute by being appropriately connected to large numbers of similar units. See Feldman, Reference (2). The basic premise of stored program computers, on the other hand, is controlled data flows. The connectionist system requires very little data flow because of its other basic premise that all knowledge in the system is available simultaneously through its connections and weights. See Fahlman and Hinton, Reference (3). A distinction between the connectionist researcher and the neural network researcher is that the latter is more interested in the circuit level aspects while the former is more interested in using those circuits in a higher level system.

Another characteristic of current connectionist systems is that each identifiable object in the set has its own processing element. See Fahlman, ibid. This leads to a massive parallelism which ideally provides the characteristic that task execution time is time invariant. This means that the system can process 10, 100, 1,000, or more objects in the same fixed unit of time; the digital computer, on the other hand, would require linearly increasing periods of time. The penalty for this promising characteristic of a connectionist system is increasing hardware requirements with problem scope. However, if the connectionist computing element can be made small, as is possible in the present invention, then this penalty is not severe. The digital computer requires additional memory space for an expanded problem, as well. In fact, if the connectionist element could be made as small as a conventional memory cell, there would be no penalty relative to the digital computer. Generally the speed advantages far outweigh other considerations in the class of real time problems of concern.

In addition to providing the features and advantages described above, it is an object of the present invention to provide a template circuit for a hybrid digital-analog computer with parallel processing including a multiplicity of gate controlled current sources receiving digital signal bits and feeding a multiple input current summer thereby parallel summing a multiplicity of level-controlled analog signals in a simple, effective, and very rapid operation.

It is another object of the present invention to provide such apparatus wherein the current sources can be programmed to respond to either 0 or 1 input bits and also programmed to output different analog signal levels.

It is still another object of the present invention to provide such apparatus wherein a multiplicity of the above template circuits and their multiple current sources are also connected in parallel and comparators at the outputs of the summers detect and identify the template circuit with maximum response.

It is a further object of the present invention to provide an entire template circuit on a single IC chip having a self-adjusting gate voltage generator circuit to provide accurate analog computation in the face of uncertain circuit element parameter values.

It is yet another object of the present invention to provide correlation-determining apparatus as above-described wherein there is more than one stage of correlation with the output of the first stage providing inputs to the second stage.

Other objects and advantages of the invention will be apparent from consideration of the following description in conjunction with the appended drawings in which.

Figure 1:
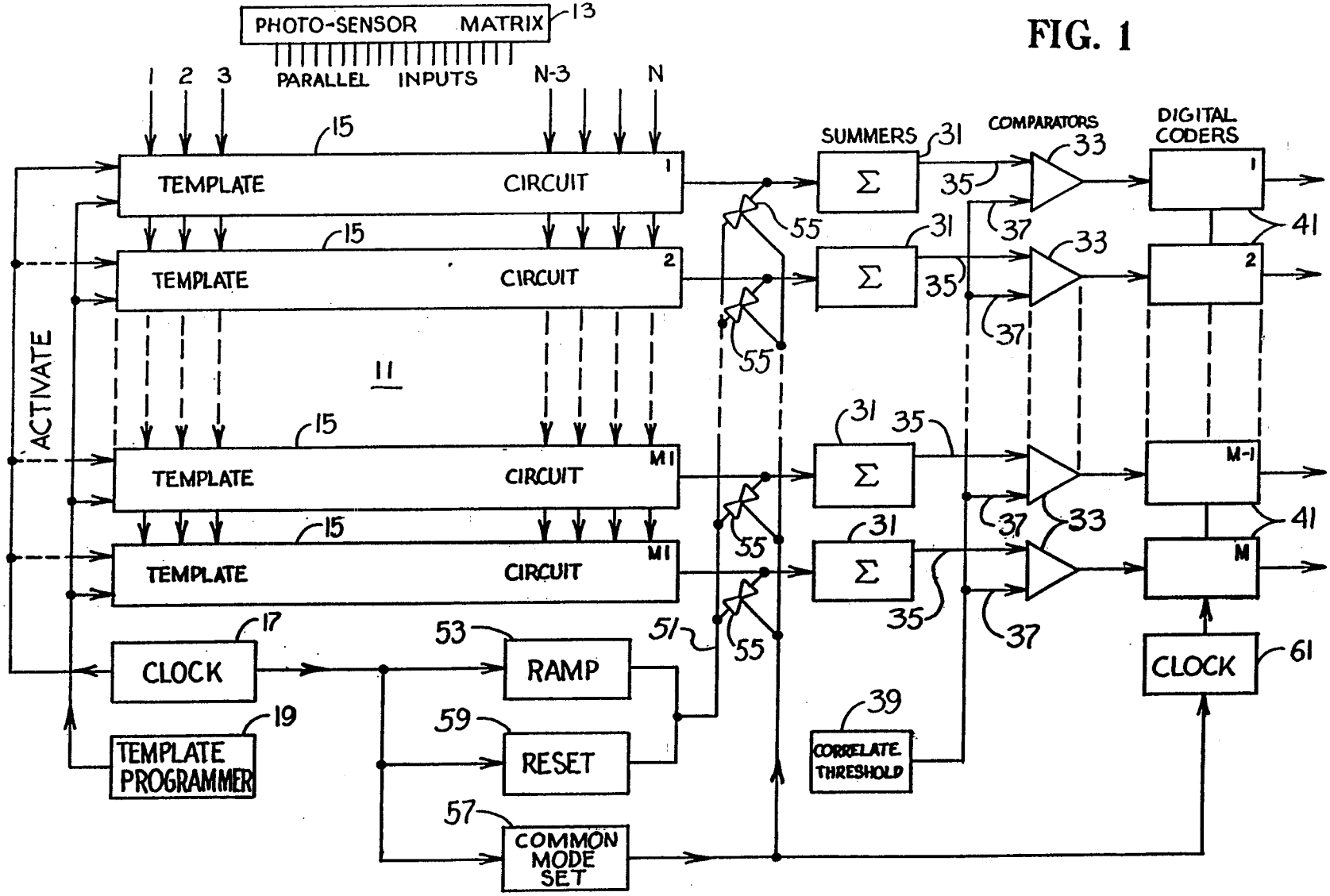
FIG. 1 is a schematic block diagram of apparatus according to the invention particularly adapted to receive inputs from a photosensor matrix to be correlated with a multiplicity of template circuits and determine the best match or matches therebetween.

Referring now to the drawings and particularly to FIG. 1, a correlation circuit 11 according to the invention is shown particularly adapted to character recognition or pattern matching. For purposes of illustration it will be considered that FIG. 1 has a basic $12 \times 16$ array for input image and stored pattern representation. Relating that to FIG. 1 there would be $12 \times 16$ or 192 parallel inputs and N would be equal to 192. The multiplicity of inputs may be from a photo-sensor matrix 13 and may be processed by digital logic circuitry before being supplied to the correlation circuit 11.

The correlation circuit 11 includes a multiplicity of template circuits 15. In the character recognition application each template circuit would represent a pattern in a set of patterns among which one seeks to find the best correlation with the pattern represented by the parallel inputs from photo-sensor matrix 13.

Although one could implement circuits according to the present invention from discrete components, the preferred embodiment is an integrated circuit (or a small number of integrated circuits) which contain all or nearly all of the multiplicities of parallel-connected hybrid analog-digital circuit elements. In more advanced versions of the apparatus, the photosensor matrix 13 might also be included on such a very large scale integrated circuit chip. Multiplicity will be defined as ten or more.

A clock 17 is provided which coordinates operations of the elements of the correlation circuit 11 and in particular provides signals to templates 15 to activate and deactivate the operation of the template circuits. Although template circuits 15 could each be permanently configured to correlate with a respective character pattern, it is preferred that the template circuits 15 be programmable as by a serial input from template programmer 19.

The number of templates 15 that will be included in a particular correlation circuit will, of course, be variable over a wide range. For character recognition as illustrated in FIG. 1, the number of template circuits would likely range from about 128 to about 400. It is desirable to recognize different character fonts without the necessity of reprogramming the circuit and some characters, such as lower case g for example, have wide variations requiring at least two different template circuits for reliable recognition; thus greater recognition versatility implies a greater number of template circuits. It is assumed that the correlation circuit 11 and photo-sensor matrix 13 would be utilized in apparatus having a provision for at least roughly centering characters in the recognition frame, however the speed of the device permits recognition by multiple correlation attempts on one character.

Figure 2:
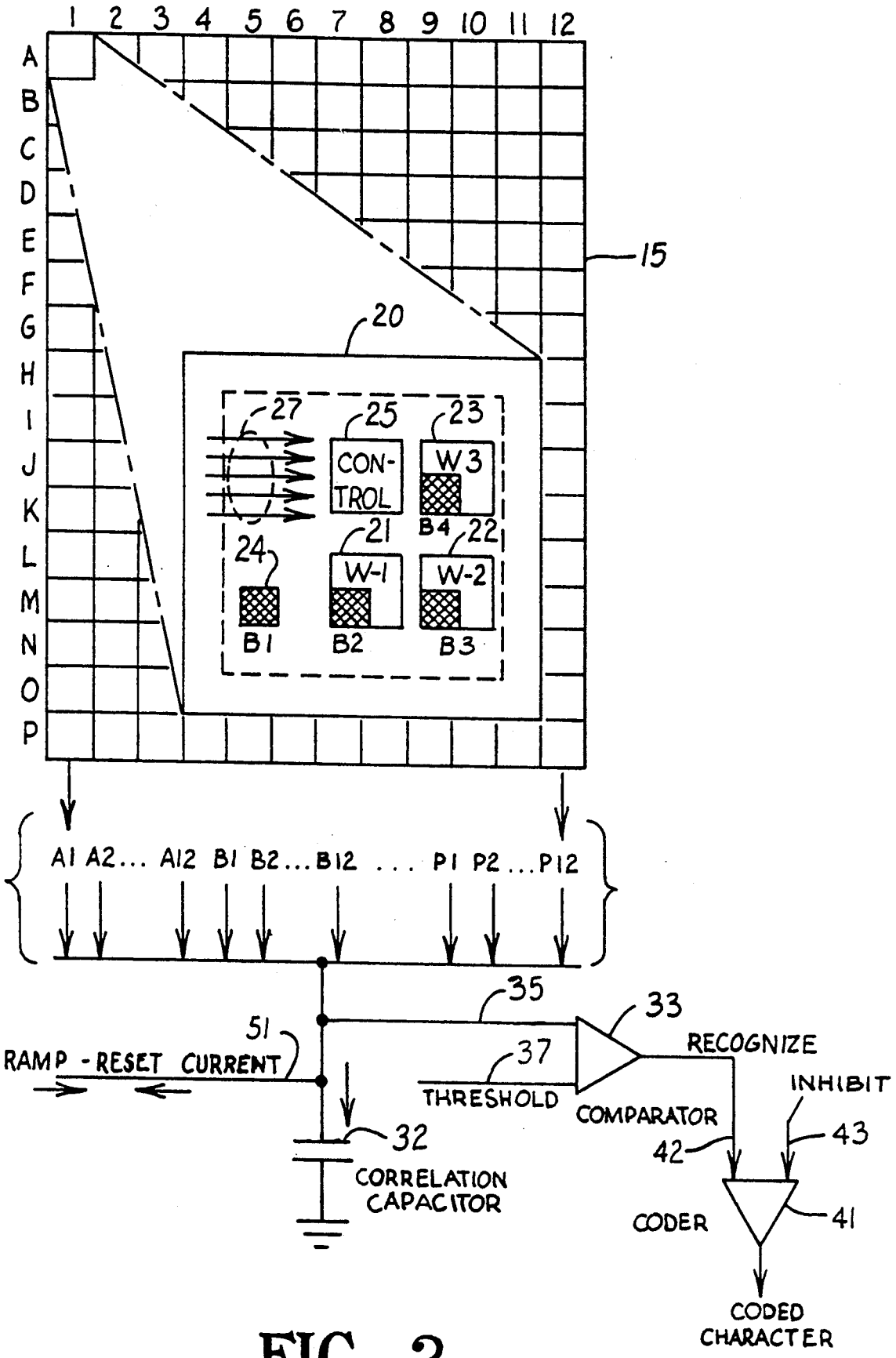
FIG. 2 is a schematic diagram of a particular embodiment of template circuits compatible with the apparatus of FIG. 1.

FIG. 2 more graphically shows the configuration of a template circuit 15 having a 12×16 array of current sources 20 with the top left (A-1) current source shown in enlarged detail. In each template circuit, 192 programmable current sources would represent an individual character pattern that has been programmed by means of serial or parallel signals or a combination thereof from template programmer 19 or some other source.

In this illustrated example, each current source is composed of three sub-sources 21, 22, and 23 to provide eight-level weighting capability for each cell. This weighting capability is desirable to successfully accommodate real life degraded image processing. As marked, the weights of cells 21, 22, and 23 are W1, W2, and W3. In a typical arrangement, W1 would be one arbitrary unit of current, W2 would be two such units, and W3 would be four such units, and the total range of current from current source 20 would range from 0 units to 7 units in eight equally spaced levels. Each of the sub-sources 21, 22, and 23 has a programmed memory bit labelled B2, B3, and B4 respectively.

Another programmable memory bit 24 (labelled B1) is preferably provided to determine whether current source 20 responds to a "zero" or a "one" pixel-input signal from photo-sensor matrix 13. Obviously, for a particular pattern, a zero signal from a particular pixel rather than a one signal may infer positive correlation and the zero - one control element associated with memory bit 24 is a particularly effective way to implement this correlation technique. The arrangement of FIGS. 1 and 2 permit all currents from the current sources to represent positive correlation. Other versions of the apparatus could offset the current scale with respect to correlation so that currents below a predetermined value would represent negative correlation.

Control gate 25 turns on the current from current source 20 in response to the image bit of the parallel input corresponding to current source 20 and the level is determined by the status of memory bits of current sub-sources 21, 22, and 23. Memory bit 24 thus acts as a match/mismatch control bit which controls the state of the image bit required to turn on the control gate 25 and the current sub-sources for that pixel. If B1=0, the pixel current sources are turned on when the image bit is "1". If B1=1, the pixel current sub-sources are turned on if the image bit is "0". This technique eliminates the need for both match and mismatch correlation and may permit the entire match/mismatch correlation to be done in one integrated circuit.

The current source 20 and all other current sources are connected to an address bus 27 which allows the template programming apparatus to load a four-bit value into the current source cell for each pixel.

The template circuits 15 in FIG. 1 each have current sources 20 respectively controlled by inputs 1 through N and having outputs labelled A1 through P12 as indicated in FIG. 2. All the current sources of each template 15 are connected to the summing junction input of a summer 31 which will typically be a solid state operational amplifier connected as a summing amplifier. The summers 31 preferably are arranged to integrate the received current flow with respect to time by charging a capacitor or otherwise. This may be accomplished by having an operational amplifier circuit function both to sum the multiple inputs and integrate the current value with respect to time to produce an output voltage representative of the time integrated sum.

The integration time of summers 31 is typically very short since the principal function of the integration is to briefly generate a voltage value corresponding to the sum of the currents from the first through Nth current source of the corresponding template circuit 15. The interval of time during which the correlation sum is generated for a particular template 15 will typically be less than one micro-second.

Each of the 1 through M summers 31 provides an output to an associated comparator 33 at a comparator input 35. Each comparator 33 has a second input 37, and all inputs 37 are connected in common to receive a voltage signal representing the correlate threshold from threshold voltage generator 39.

The basic correlation function may be provided very simply by the elements described above in the following manner. Considering the template circuit 15 illustrated in FIG. 2, the current source 20 corresponding to pixel A1 may be programmed to produce a current in response to a zero signal from the first parallel input having a weight of 4, let us say. Each of the other current sources 20 of the template circuit 15 illustrated in FIG. 2 will be programmed to produce a predetermined current at one of eight different levels in response to either a zero or a one signal from its corresponding parallel input from photo-sensor matrix 13. The currents from all current sources 20 of template circuit 15 illustrated in FIG. 2 are summed in effect by the accumulated charge on correlation capacitor 32 contained in summer 31 of FIG. 1. More accurately it is the rate of change of voltage on the correlation capacitor 32 which represents the current total from template circuit 15 and hence represents the degree of correlation of the pattern programmed in template 15 with the image represented by the digital signals on parallel inputs from photo-sensor matrix 13.

All the template circuits are operating in a manner described immediately above, and the rate of change of the voltage output from a correlation capacitor 32 of each summer 31 is a measure of the correlation between the pattern of the corresponding template circuit and the pattern represented by the parallel inputs from photo-sensor matrix 13. As the output voltages from summers 31 increase by reason of integration of the currents received, that one of the summers 31 having the greatest rate of increase of voltage would eventually produce an output voltage equal to some predetermined voltage. Thus the template circuit and the character pattern having the greatest correlation with the pattern represented by the parallel inputs from photo-sensor matrix 13 could be determined by the first of comparators 33 to produce an output signal.

The output of each comparator 33 is supplied to a corresponding digital coder 41 as indicated in FIG. 1 and FIG. 2. Digital coders 41 function to transmit a binary coded signal identifying the one of the M digital coders receiving the first output from its corresponding comparator 33 thereby identifying the template circuit 15 with the best correlation relative to the parallel inputs momentarily supplied from photo-sensor matrix 13.

In a simple arrangement illustrated in FIG. 2 each digital coder 41 is provided with an inhibit input 43 in addition to the recognize input 42. A signal at inhibit inputs 43 of all coders 41 is produced immediately following the reception of the first output from any comparator 33 thereby assuring that only one of the digital coders 41 transmits an identifying code. Otherwise successive transmissions would be produced at digital coders 41 when summers 31 with the second, third, fourth, etc. highest correlations reach the correlate threshold set by threshold generator 39.

In a simple character recognition apparatus the output from digital coders 41 may simply represent the ASCII code for the character pattern programmed into the corresponding template circuit.

The distinctive signals from digital coders 41 normally will be provided to a digital stack, a digital processor, or a hybrid processor for further processing of the character recognition or pattern identification correlation data.

The correlation function R, represented by the total charge on the correlation capacitor, may be defined mathematically as:

$$R = \sum_{m=1}^{12} \sum_{n=1}^{16} p(m,n) * t(m,n)$$

where $$p(m,n) = 1,0 \quad (1)$$

$$t(m,n) = 0\text{–}7 \quad (2)$$

p(m,n) represents the image array input and t(m,n) represents the template mask. The multiplication function is accomplished by gating on or holding off previously weighted current sources represented by that template mask; the summation function is accomplished by the individual gated currents' contribution to the total charge on the capacitor for that template. Determining the identity of the input image then involves finding the summer correlation capacitor of the group of template masks with the largest charge. Although this could be done most simply by setting the integration interval sufficiently long so that one of the capacitor charges would reach a predetermined value indicating maximum charge for that capacitor and maximum correlation for the corresponding template mask, that is not the preferred arrangement. It is preferred that an additional charging current be applied to all correlation capacitors 32 in parallel until the first one reaches a predetermined value. Since all such integrating capacitors have the same current supplied and hence the same charging rate, the first capacitor 32 to reach the predetermined threshold value had the highest correlation charge initially. By continuing to apply this "firing" or ramp current, comparators 31 associated with the masks will fire in succession to provide an ordered set of correlation results. Usually the first to fire is the important one, but, in many cases, it is desirable to know both the sequence and the separations between the first and the others. If desired, each template mask may incorporate a normalization adjustment in the summer stage so that valid comparisons can be made between masks notwithstanding different numbers of programmed current source weights.

Figure 3:
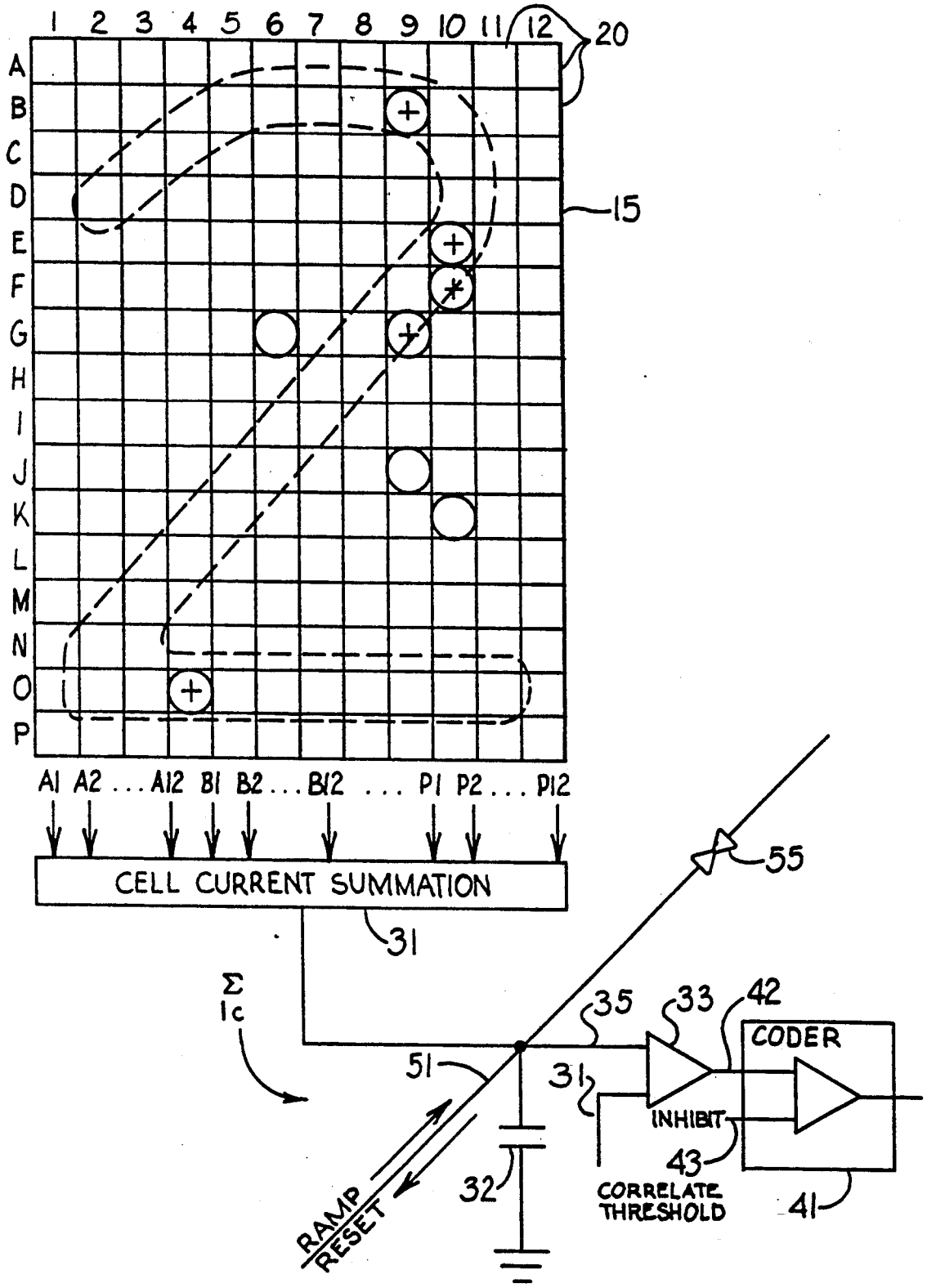
FIG. 3 is a diagram illustrating the operation of apparatus of FIGS. 1 and 2 in a character recognition mode.

FIG. 3 illustrates a template mask for the character "2". Exemplary weights for certain of the current source cells are shown in TABLE I below. Note that for certain cells and current sources marked with a+-sign have their programmable memory bit 24 set to respond to a pixel input of one while other cells and current sources are oppositely set to respond to a pixel input of zero. In either case this is a positive indication of correlation with the pattern for a "2" character.

TABLE I

| Cell | Weight |
|---|---|
| For Image Bit = 1 | |
| B-9 | 8 |
| F-10 | 4 |
| G-9 | 5 |
| E-10 | 8 |
| O-4 | 8 |
| For Image Bit = 0 | |
| G-6 | 5 |
| J-9 | 6 |
| K-10 | 8 |

Although weights and zero-one response status are shown for only a few of the cells in FIG. 3 for illustration, all of the cells would be programmed and most of them would have some weight other than zero. In the illustrated embodiment weighted values are predetermined by character template mask designs appropriate to the type fonts or other character patterns one seeks to recognize. In the general case, however, weighting values determining template masks could be derived from adaptive learning routines, or, in the case of pattern identification, from actual image scene photo-sensor matrix outputs whereby the system would be capable of self-training to recognize that scene or subpattern. Well known algorithms for adaptive learning exist and are not a part of the present invention.

As previously mentioned, the preferred mode of operation for apparatus as illustrated in FIG. 1 and FIG. 2 includes provisions of a firing or ramp current supplied in parallel to the correlation capacitors 32 of each of the summers 31 until the summer 31 with the greatest charge reaches the threshold voltage set by the threshold voltage generator 39. Such an arrangement is schematically shown in FIG. 1 wherein a current bus 51 is connected to receive a charging current flow from ramp current generator 53 which is turned on and off in response to signals from clock 17.

Current bus 51 is connected through respective gates 55 to the input of each summer 31. When template circuits 15 are activated, gates 55 are closed and summers 31 are individually connected to their corresponding template circuits 15 and not to bus 51. However, template circuits 15 are activated only for a predetermined interval and when they are off gates 55 are turned on by a common mode set signal from the common mode signal generator 57 and ramp current generator 53 is also activated to provide current flows to rapidly charge all summers 31 at equal rates until the output from one of the summers 31 exceeds the threshold determined by threshold generator 39. This preferred embodiment provides a more efficient determination of the summer 31 having the correlation capacitor 32 with the highest charge, as compared with extending the active period of operation of template circuits 15 until some threshold level was reached. Otherwise the operation is the same as previously described for the simpler case. Current bus 51 is also used to reset the summers 31 to zero by turning off ramp current generator 53 and turning on reset or discharge current element 59.

Figure 9:
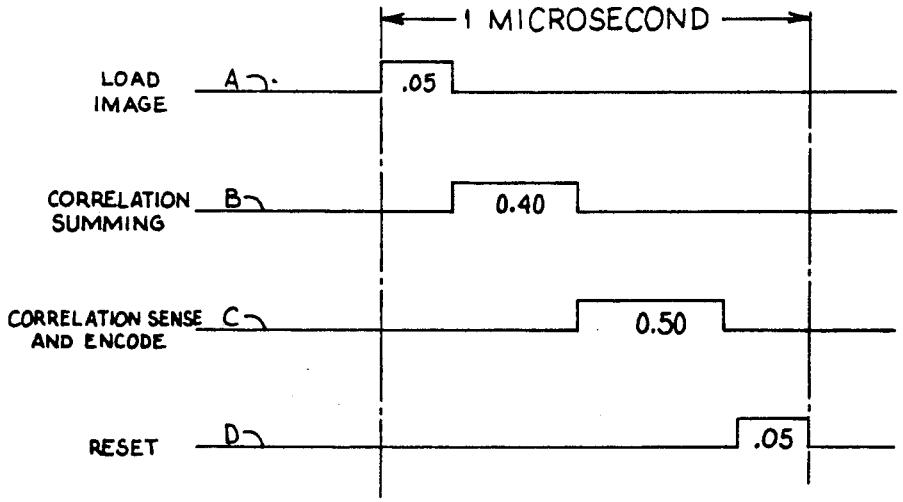
FIG. 9 is a timing diagram applicable to FIGS. 1–5.

The sequence of events described can be better understood by reference to FIG. 9 showing a timing diagram with exemplary times for a practically realizable circuit. As shown in FIG. 9, the wave form A represents the portion of a cycle during which parallel inputs from photo-sensor matrix 13 cause the image to be loaded into all the template circuits 15 by setting the state of bits B1, B2, B3, and B4 in each of the M×N current sources (in this example M×N equals 76,800). The on-time for wave form A is 0.05 micro-seconds. Wave form B of FIG. 9 represents the on-time for the correlation function which occurs as currents from all the current sources of each template circuit are summed and integrated to charge a correlation capacitor of a respective summer 31. Gates 55 are closed during this interval. Wave form B on-time is 0.40 micro-seconds.

Wave form C shows the wave form for the correlation sense and encode portion of the cycle which has an on-time of 0.50 micro-seconds commencing after the termination of the correlation summing operation. During this time ramp current generator 53 is on and gates 55 are open causing one of the comparators 33 to be activated sending a signal to its cooperating digital coder which produces a signal identifying the template with the mask having highest correlation. Wave form D is the on-time for the reset portion of the cycle following the correlation sense and encode portion. The reset portion has a length of 0.05 micro-seconds.

In this period reset current element 59 is on, allowing discharge current from capacitors 32 of summers 31 and thereby resetting the apparatus for a new image load operation. The total cycle time is one micro-second.

FIG. 1 also illustrates another refinement over the basic system in that a second clock 61 is provided which supplies elapsed time signals to digital coders 41. The clock 61 is started by common mode signal element 57 and the signal from clock 61 is a measure of the integrated ramp current provided to the correlation capacitors of summers 31. Thus when a comparator 33 transmits a trigger signal to a digital coder 41 the elapsed time signal of clock 61 at that time measures the difference between the original charge on the correlation capacitor 32 of summer 31 and the threshold voltage set by threshold generator 39. If clock 61 is a count-down clock it will provide a direct measure of the correlation sum value when a comparator 33 detects a threshold crossing. Thus in a more sophisticated embodiment digital coders 41 may output a digital identification of each of the template circuits together with the digital correlation values for the circuits. If such great detail was not desired then only the first few (and the highest correlations) signals from digital coders 41 could be transmitted to a digital stack for further processing.

Numerous variations other than those described may be of value in adapting the apparatus of the present invention to different purposes. Also, the components of apparatus according to the present invention may be replaced by equivalent elements which operate in inverse manner or elements equivalent under the principle of duality. For example, the weighting system for the template circuits could be inverted with low weights corresponding to high correlation. The greatest correlation would then correspond to the minimum integrated current and the minimum correlation capacitor charge. The low integrated current value could be found by discharging to reach a low or zero value in essentially the opposite manner of that described with respect to FIG. 1.

It should be pointed out that the template circuits of the present invention have very broad applications and "template" is to be considered in its broadest possible sense. The principal illustrated embodiments of the invention are examples directed to character recognition or pattern classification and the preferred embodiments have inputs to the template circuit which are single-bit digital inputs.

Clearly, other embodiments of the invention could employ multiple-bit digital inputs to the template circuits. Thus, two binary inputs could represent up to four values for a particular variable. Giving the cells fed by the two inputs weights of one and two respectively would provide a conventional two-digit binary input to the summing circuit for the template. Additional digits of binary notation could be added by adding additional inputs and cells with weights of successively higher powers of two. Other than binary digital notation could be employed.

It will be seen that template circuits according to the invention have some of the aspects of a look-up table, but while digital look-up tables require a number of steps for one look-up operation, the parallel nature of the template circuits performs the "look-up" in a single operation.

The power and versatility of the template circuit is further illustrated by its use in a parallel multiplier. Consider the conventional long multiplication process with two four-digit numbers. Binary numbers, as well as decimal numbers, can be multiplied in this fashion. There are sixteen partial products generated (most of which may be zero). In the case of binary numbers, each partial product generated can have only two values, a pre-determined power of two, or zero. Sixteen logical "and" circuits connected to receive all possible combinations of a bit of the multiplier and a bit of the multiplicand will provide sixteen outputs corresponding to the sixteen partial products, and, if each of these outputs is weighted with the power of two corresponding to the product value, then the sum of the non-zero weighted products will be the value of the product of the four-digit multiplier and the four-digit multiplicand. Thus, if a template circuit with appropriate power-of-two weights for the cells is connected to receive sixteen inputs representing the possible combinations of the digits of a four-digit multiplier and a four-digit multiplicand, the sum of the currents from the sixteen cells will be the product of the four-digit multiplier and the four-digit multiplicand. Larger numbers would require a greater number of digits for representation but for sixteen bits the maximum number of cells (256) is still not excessive. One may choose to ignore the lowest order partial products.

If one wished to dedicate a template circuit to the parallel multiplication function then the necessary "and" circuits to identify the non-zero product terms would, in most cases, be included in the template circuit itself thereby requiring no preliminary processing of the binary digital data. Thus, the number of inputs for two N-digit numbers would be 2N rather than $N^2$.

From the foregoing example it will be seen that the template circuits according to the present invention have wide-ranging applications not limited to character recognition or pattern classification. In general, a computing function requiring the addition of many addends and wherein the accuracy of the result required is within the capability of analog circuit apparatus may employ template circuits according to the invention. This may be expected to provide at least moderately improved, and possibly vastly improved, speed of operation with little or no increase in circuit complexity as compared to conventional digital computer circuits (whether these be entirely serial or partially parallel in operation).

An important advantage of the method described and the apparatus for carrying it out is that it may be a totally parallel analog system wherein the input image is applied to all stored patterns simultaneously and all correlations are accomplished simultaneously. The time required is expected to be only a few micro-seconds with a lower limit of less than a micro-second. It is worthy of note that this correlation time is not a function of the number of template masks in the system as would be the case with digital computer based techniques. Processing time is essentially the same for either 40 or 400 template masks; this is of great importance in real time systems for scene analysis or recognition.

Even allowing for substantial overhead time not attributable to the correlation function itself, character recognition rates of up to a hundred thousand characters per second should be achieved with apparatus and methods according to the invention. Known character recognition techniques, even those which use some parallel processing, are considered to have very good performance at one thousand characters per second.

A comparison of present apparatus and methods with digital processing shows the power of the technique of analog summing of a multiplicity of weighted current signals. As seen previously, a four hundred mask optical character recognition system utilizing a twelve by sixteen pixel frame would require 76,800 digital computations. Even though they are relatively simple computations, an expected rate of 0.2 micro-seconds per computation is not unrealistic so that the correlation time would be approximately 15 milliseconds. On the other hand, the hybrid analog-digital correlator utilizing analog summing of a multiplicity of addends according to the invention is massively parallel with all operations taking place simultaneously. The entire process may be expected to take two microseconds or 0.002 milliseconds as compared with the 15 milliseconds for digital processing.

Practical application of this technique optimally requires that the basic analog-digital processing element be on one integrated circuit semi-conductor die. Fortunately this is readily possible with present commercial semi-conductor technology. Continuing with the previous example, each programmable current source 20 would include three sub-sources to provide eight-level weighting which would imply a total of 576 precision current source cells for each character template circuit. There would also be five bits of digital storage for each cell (one bit for control, one for zero-one response, and three for current weighting information). This gives a total of 960 digital cells to which would be added a current generator, summation node, two amplifier circuits and necessary support circuits. Assuming a one-micron feature definition process, one can postulate ten or more templates with their associated circuits on one integrated circuit chip. As the technology advances to 0.25–0.5 micron capability it becomes feasible to place a sophisticated alpha-numeric character recognition system with up to 400 templates on one integrated circuit chip.

A correlator of the present invention can also be used to implement majority logic functions of several hundred terms simply and at high speed. Majority logic functions provide an output if some predetermined percentage of the input terms are true, independent of any specific term being necessarily true. This is a problem which cannot be practically solved with conventional digital logic gates. A 100 term expression represents $2^{100}$ or about $10^{30}$ logical conditions to be combined; all terms from this decoding which contains the percentage of true terms desired may then be "OR'ed" together to provide the desired results; this implementation is not practical and as a result most majority evaluation functions must be done on a stored program computer, which is slow and expensive. This function is a simple operation for a correlator of the present invention; all current weighting values of each input term are set equal and a reference voltage is applied to the comparator such that a given percentage of input terms must be present to fire the comparator.

Conversely, if the number of true input terms present is desired to be known, then a ramp voltage is applied to the comparator. The value of the ramp at the time of firing is a direct indication of the number of true terms present. Similarly, if a range of majority inputs is desired (say 50–70%) then two correlators can be used. The first correlator A is set to fire at 50% input; the second correlator B is set to fire at 70% input. The condition of input terms present between 50–70% is then represented by A=true and B=false.

Majority logic using weighted input values, both positive and negative, can also be handled easily. In this case, we can determine total weighted input score ranges, not the number of terms present. Typical examples of the use of these capabilities are:

(1) Area density measurements for image processing functions, i.e., the number of pixels set in an image sub-area.

(2) Evaluation of Rule Based systems with large numbers of weighted rules, each rule containing a large number of terms.

(3) Partial analysis/decoding/classification of long logical expressions, using Boolean algebra or similar algorithms.

(4) Use in "Fuzzy Logic" systems in which all information may not be present, but a best decision is required.

Most or all of the above applications and utilization of computation apparatus according to the invention may gainfully employ integrated circuit chips implemented with circuit elements of unknown parameter values as will later be described in detail with reference to FIGS. 7 and 8. Such current summing integrated circuit chips require that all current sources feeding a particular current summer shall be on the same circuit chip. This presents no problem since at least several hundred current sources and the necessary associated circuitry can be readily accommodated on one large-scale or very large-scale integrated circuit chip. In many cases multiple summers together with all their respective current sources can be placed on one chip.

Of course, the fundamental operation of the apparatus for summing a multiplicity of addends is not dependent on integrated circuit electronics or even on transistor electronics. This is the best forseeable mode of implementation, however.

It should be noted that the practicality of the apparatus is not in any way dependent on placing the entire character recognition or pattern identification circuitry on a single chip. In fact, the interconnection problem is less severe with the present apparatus than with other parallel processing apparatus and techniques. Obviously, the apparatus must accept the multiplicity of parallel inputs with whatever interconnection problem that entails. But once it is possible to put a template circuit and its associated summer and comparator on a single chip only one output connection per template circuit is required, and relatively few other control inputs are needed.

Figure 4:
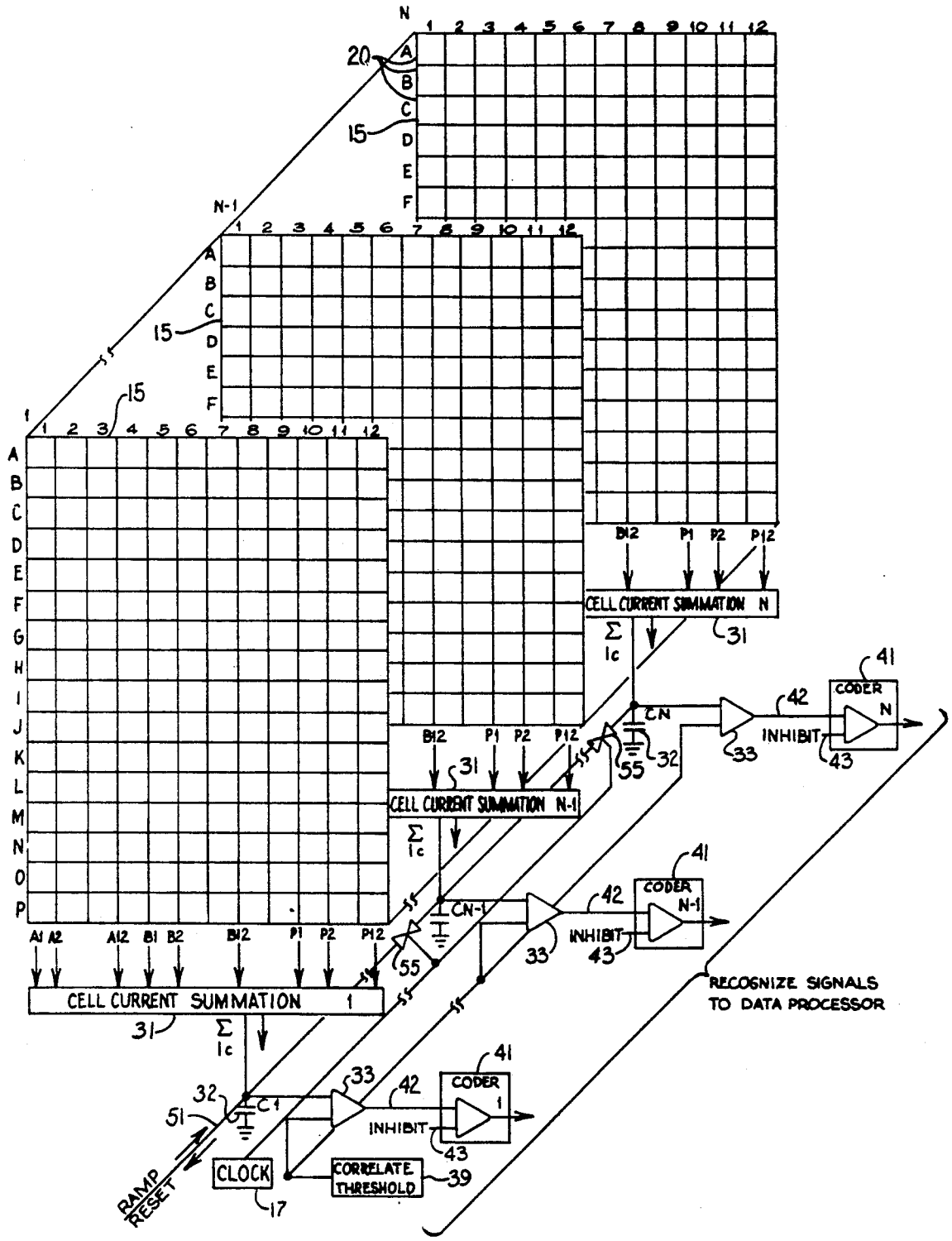
FIG. 4 is a graphic illustration of a portion of a character recognition system as illustrated in FIGS. 1–3 useful in explaining the operation thereof.

FIG. 4 is a graphic schematic illustration showing the way that a template mask for the character "2" (FIG. 3) is assembled with other character template masks to provide the correlator for a character recognition system. Note that all the template circuits are identical; only the programmable weights vary in location and in magnitude between the individual templates. Furthermore, reprogramming the weight and status bits in different locations of the templates would allow use of the identical correlator for characters of a different language, different type fonts, or the like. For convenience, the reference numbers of FIG. 4 correspond to those for FIGS. 1, 2 and 3.

The operation of the apparatus schematically illustrated in FIG. 4 is substantially as previously described with reference to FIGS. 1, 2 and 3. That is, multiplication by the correlation weight is accomplished by gating on or holding off the previously weighted current sources 20; summation function is accomplished by summers 31 providing the integrated charge on the correlation capacitors 32 for the respective templates. Determining the identity of the input image with greatest correlation then involves finding the correlation capacitor in the group of template masks with the largest charge. This is done by an additional charging current applied to all template correlation capacitors in parallel by opening gates 55.

When the first of the correlation capacitors 32 reaches a predetermined value set by correlate threshold generator 39, that capacitor is identified as having had the highest correlation charge initially. A comparator 33 senses this event and signals its corresponding coder 41 to generate and transmit a code identifying the correlation mask with the greatest correlation. This simple operation of the correlation circuit may be elaborated on to provide further refinements, some of which have been previously described. It may be noted that two or more summers may be employed in one template; different current sub-sources for one pixel could go to different summers with different weight factors. Some or all current sub-source weighting could be accomplished in such summers.

Correlation computation apparatus according to the invention can be used in multi-layer applications as well, that is one layer of correlators driving another layer of correlators. In fact, a slightly modified correlator may be used to perform a dynamic thresholding function on a gray scale input image to derive the binary image form which drives the correlator template array. Dynamic thresholding is a technique which makes a gray scale to binary image conversion with a minimum loss of information in the process.

Figure 5:
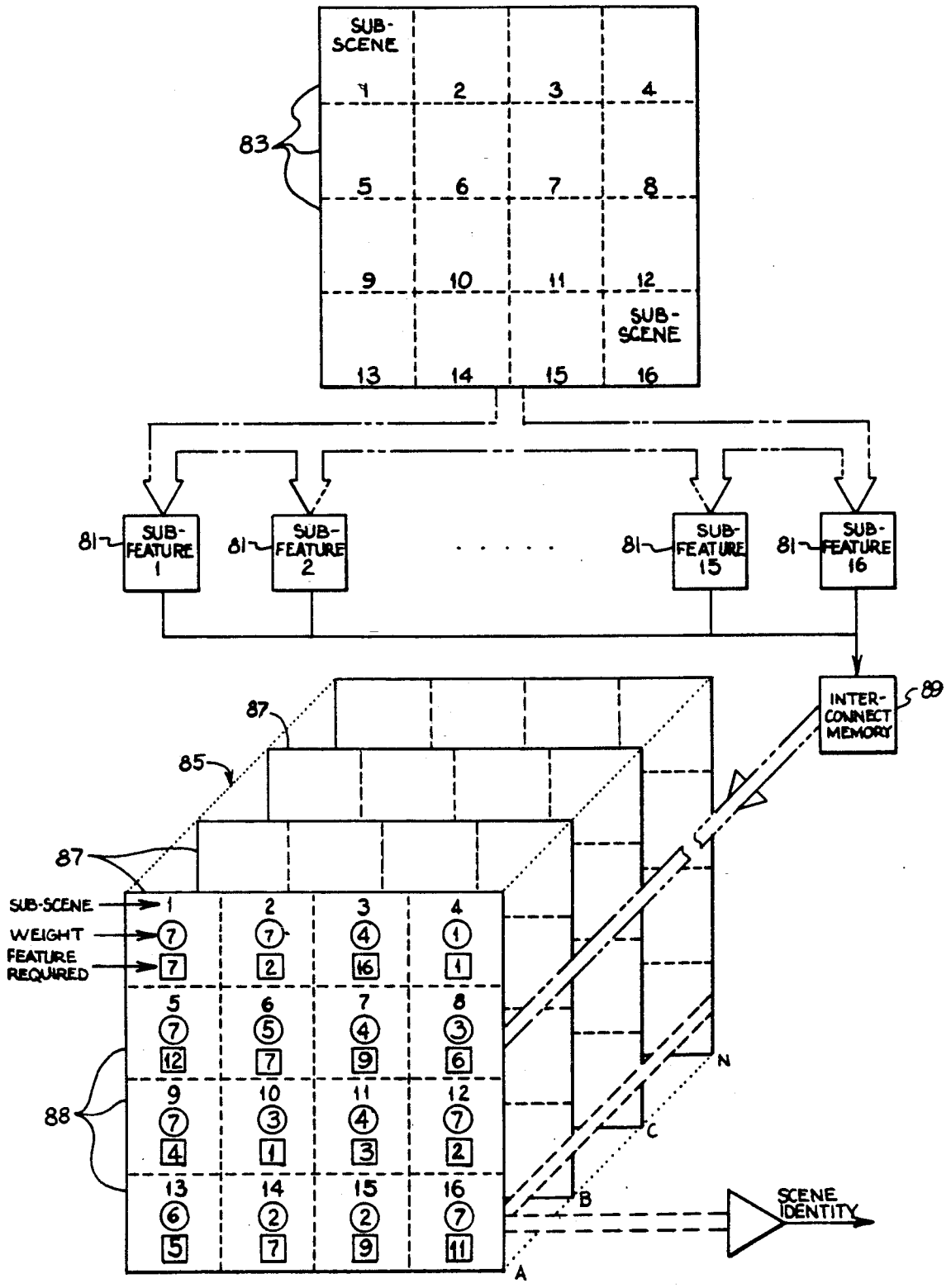
FIG. 5 is a schematic illustration of an alternative embodiment of pattern or scene identification apparatus according to the invention in which there are two stages of correlation determination operating in cascade.

A multi-layer correlation example is shown in FIG. 5 which performs a large scale scene analysis by using a first layer of correlators to identify feature objects 81 in sub-scene area 83 in the manner previously described; these feature objects are then integrated into a complete scene recognition analysis by a second layer of correlators 85. The second layer combines the basic features found in layer one into the proper spatial relationships, and, with the predetermined weightings, to match the complete scene with a stored ensemble of scene feature masks 87. In this case the features derived at the first level are transmitted to the second level as scene inputs only to those templates calling for that particular feature. The small interconnect memory 89 performs this mapping function. By adding another layer driven by the present and previously stored image feature arrays, both spatial and temporal processing can be accomplished in real time with minimum hardware.

As was seen in the discussion of the apparatus of FIG. 1, there is a minimal amount of cross-connection between parallel inputs in the correlation type apparatus disclosed and described. Many known parallel processing schemes require that each input be cross-connected to many or sometimes all of the other parallel inputs with a discrete connecting path. The absence of the necessity for numerous cross-connections in the present invention is obviously an advantage in maintaining simplicity while accomodating a large number of parallel inputs.

Figure 6:
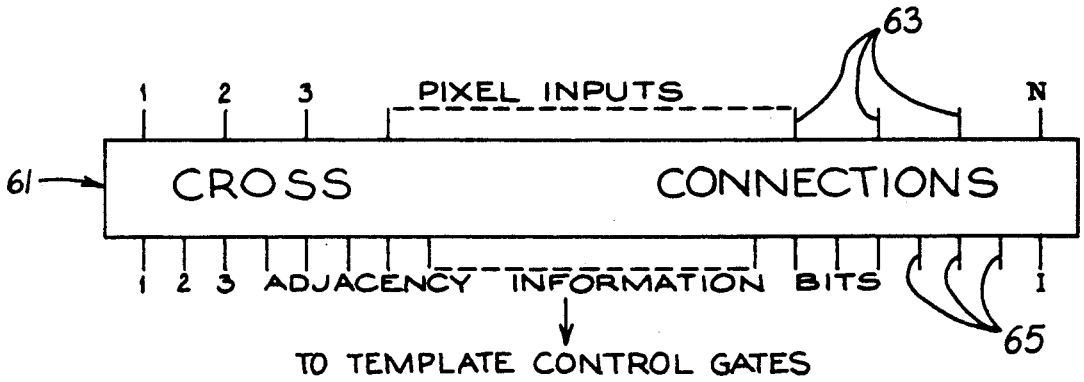
FIG. 6 is a schematic illustration of cross-connection apparatus which may be employed in connection with or incorporated into the apparatus of FIG. 1.

It should be noted, however, that cross-connections between parallel inputs may be employed in conjunction with the apparatus of the present invention where it is advantageous to do so. FIG. 6 illustrates a cross-connection sub-section 61 which may be interposed between the photo-sensor matrix 13 and the template circuits 15 of FIG. 1, for example.

Cross-connection sub-circuit 61 has a multiplicity of inputs 63 which would correspond in number to the photo-sensor matrix outputs. The cross-connection sub-section may comprise semiconductor logic cells for producing digital signals on outputs 65 corresponding to logical "AND", "OR", "XOR", etc., functions of the signals on two or more of the inputs 63. The number of the outputs 65 may be equal to, greater than, or less than the number of inputs 63.

By way of example, each output 65 could be the exclusive OR-XOR function of two horizontally adjacent pixel inputs, thereby indicating a vertical edge in the image. The same function could be derived for horizontal edges using vertically adjacent pixels. These functions would then act as inputs to the templates in place of or in addition to the pixel inputs. Cross-connections may be useful in other applications of the apparatus according to the invention. Any cross-connection sub-circuit may be on a separate integrated circuit chip or it may be incorporated on a integrated circuit chip together with one or more template circuits, whichever is most effective in the circumstances.

Figure 7:
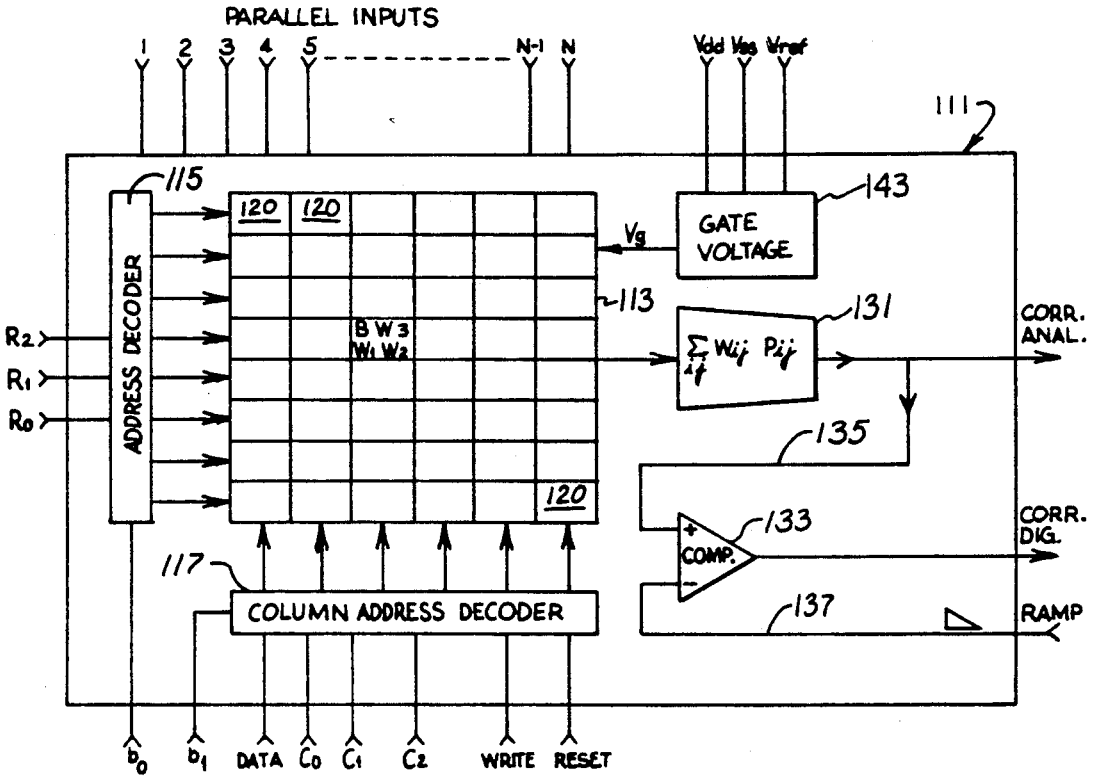
FIG. 7 is a schematic block diagram of a preferred integrated circuit template circuit according to the invention.
Figure 8:
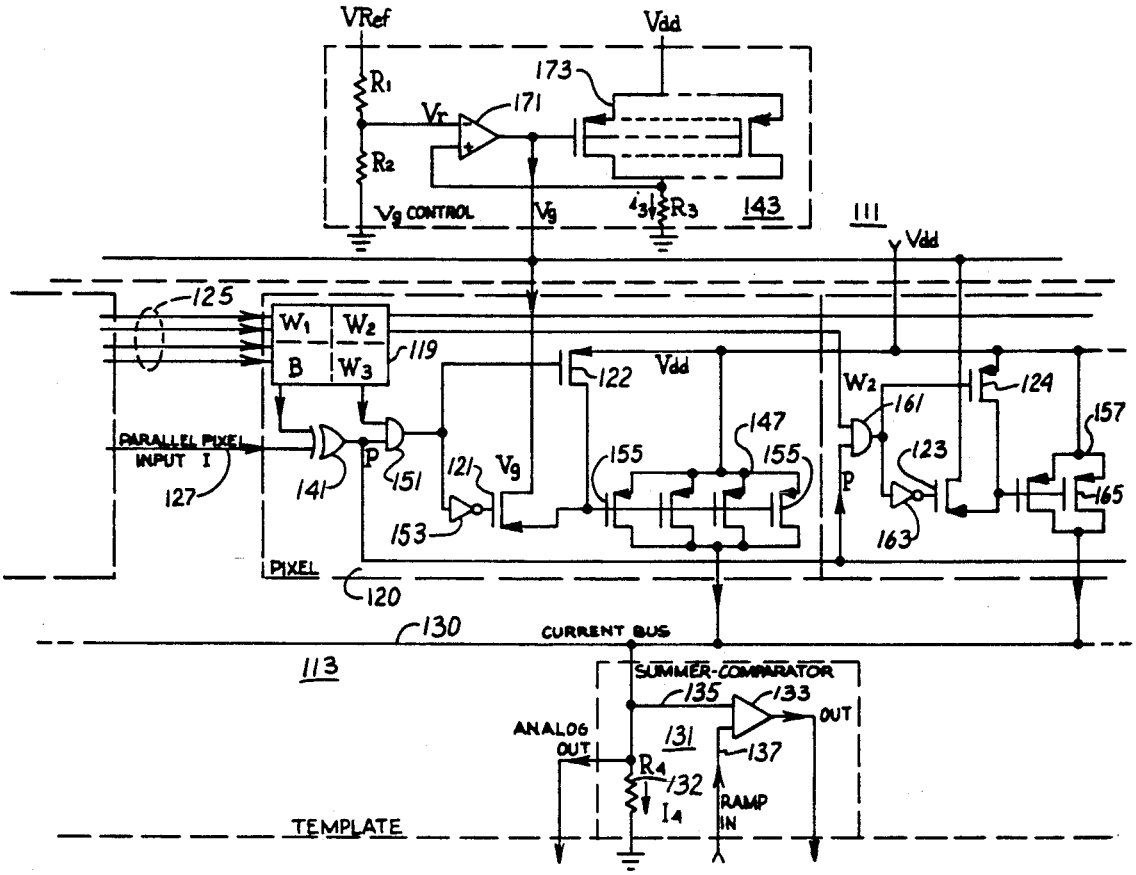
FIG. 8 is a detailed schematic circuit diagram of a portion of the device of FIG. 7.

Referring to FIGS. 7 and 8, specific circuitry is shown for very large scale integrated circuits involving the present invention wherein the analog computations are performed with exceptionally good accuracy and reliability. For the purpose of illustration, circuitry is shown for a hybrid digital-analog computer correlation apparatus having all the circuitry required for one template circuit as previously described on a single integrated circuit chip. Of course, more than one template may be placed on a single chip within the constraints of the state of the integrated circuit art.

The template circuit shown for illustration has programmable current source weights in a 6 pixel by 8 pixel frame suitable for pattern identification or character recognition. Only one of the numerous templates that would be required for pattern identification or character recognition apparatus is shown and described. Since the template apparatus illustrated is programmable, all templates could be identical as to their hardware.

The apparatus illustrated in FIGS. 7 and 8 is, of course, generally very similar to that previously described, but it employs slightly different means and methods for summing current and identifying a template with the highest correlation. These differences will be pointed out in the course of the explanation.

The correlator chip 111 of FIGS. 7 and 8 simulates a perceptron style neuron with 48 inputs arrayed in an 8 by 6 grid. Each input represents a binary bit or pixel in an 8 by 6 binary image. Each input has an integer weight in the range of 0–7 represented by a three-bit binary number.

If $p_{ij}$ be pixel (i,j) and $W_{ij}$ is the weight of the input on pixel (i,j), the correlation chip will provide an analog output given by $$V_c = a + b \sum_{i=0}^{7} \sum_{j=0}^{5} W_{ij} P_{ij}, \text{ where} \quad (3)$$

a and b are known constants; for example $$a = 1.667 \text{ (for } V_{ref} = 5 \text{ volts)} \quad (4)$$

$$b = 2.5 \times 10^{-3} \text{ (for } V_{ref} = 5 \text{ volts)} \quad (5)$$

The pixel values and weights are stored in static RAM in the chip. The correlator chip provides both an analog and a digital output. It will be seen that $V_c$ varies from 1.667 volts to (1.667+0.84) volts, depending on the weights and pixel values. If the maximum average weight of a template current source was substantially less than 7 and was known, then constant b could be adjusted upward while maintaining the same range for $V_c$. As in the apparatus of FIGS. 1–6 it is anticipated that normally several hundred correlators chips will examine the same image simultaneously. The chip giving the highest correlation would be taken as the best identification of the pattern of the image. Apparatus of FIGS. 7 and 8 represents a variation of the arrangement shown in FIG. 1 in respect to the summing of currents and the identification of the highest correlation template.

It will be recalled that in the apparatus of FIGS. 1–4 previously described, summers 31 included a capacitor which was charged by the total current from the current sources of a template during a prescribed time interval. Thus it was the time-integrated current which produced the voltage at the output of the summers 31 to be compared with a correlate threshold voltage from the correlate threshold circuit 39. In the apparatus of FIGS. 7 and 8 the current from all current sources is merged and summed in a resistor so that it is the instantaneous current which provides a voltage to the comparator rather than the time-integrated sum of the current.

Substituting the current summing correlation resistor of FIGS. 7 and 8 for the correlation capacitor of FIGS. 2, 3, and 4 makes it unnecessary to carefully time the interval during which the template circuits are activated. It also makes it unnecessary to discharge the correlation capacitors with the reset current source 59.

Another difference of the circuits of FIGS. 7 and 8 is the maximum correlation detection scheme which involves down-ramping the correlation threshold signal 37 supplied to the comparator 33. The result is the same, namely that the first comparator to fire is the comparator with the highest correlation. This arrangement makes it unnecessary, however, to provide the current bus 51, the gates 55 and the common mode set circuit 57. The ramp generator circuit 53 may instead be connected to provide a down-ramp to the correlate threshold circuit 39.

If 400 chips are examining the image simultaneously one would place the same falling ramp on the ramp inputs of all 400 chips. As long as the ramp voltage is greater than the highest correlation voltage, all comparator outputs are 0. The first comparator output to rise will be the output of the chip with the highest correlation. As before, a digital encoder can determine the address of the chip with the first comparator output pulse.

FIG. 7 is a schematic diagram of an integrated circuit chip for a correlator according to the invention and having essentially all the circuitry required for one template and its associated summer and comparator. For illustration the template is arranged for 6 by 8 pixel pattern correlation. This rather small pixel array is convenient for the purpose of explanation but larger arrays may be employed. Multiplicity is defined as ten or more.

Chip 111 has a current source array 113 comprising 48 current source circuits 120. Each current source circuit 120 represents 1 pixel. Although the geometry of the current source array 113 corresponds to the image pixel array in this case, that is not significant. In fact, the data being correlated may be other than two-dimensional, ranging from one-dimensional data to multidimensional data.

As previously mentioned, the template illustrated in FIGS. 7 and 8 is programmable thus allowing all template circuits to be structurally identical. Each current source 120 includes four bits of memory associated respectively with the weights $W_1$, $W_2$, and $W_3$ and the zero-one response bit B. There are a number of conventional means for addressing the memory bits of the respective current sources 113 and the particular form of addressing scheme illustrated does not form a part of the present invention.

In FIG. 7, row and column addressing is provided by a row address decoder 115 and a column address decoder 117. In a well-known manner the storing of weight values in the memory bits of the current sources 120 is accomplished by coincidence of row and column signals to a particular current source 120.

This is carried out by the row address decoder 115 and the column address decoder 117 in response to binary row address signals $R_0$, $R_1$, $R_2$, and column address signals $C_0$, $C_1$, and $C_2$. The memory bits $W_1$, $W_2$, and $W_3$ and B are shown schematically at 119 in FIG. 8. Two additional inputs $B_0$ and $B_1$ are required to address one of the four memory bits in a pixel.

In the row-column addressing arrangement each weight and zero-one state memory holds four bits of data for each pixel. Three bits $W_1$, $W_2$, and $W_3$ establish the weight of the pixel and bit B represents the zero-one response state of the pixel. Data is written into memory by using $R_0$–$R_3$ and $C_0$–$C_3$ to select a pixel, $B_1$ and $B_0$ to select one of the four bits within the pixel.

The weights may all be reset by raising the reset line before new values are written in. In the embodiment illustrated in FIGS. 7 and 8, the row-column addressing scheme operates in a serial manner to input the programmed weights and zero-one states only while the pixel inputs are supplied on N parallel inputs (in this case N=48). The relatively slow process of programming the four bits of each pixel in serial fashion is acceptable because programming the templates will be done relatively infrequently. Of course, the pixel inputs could also be serially loaded into a memory bit in each current source rather than being provided on parallel inputs if one desired to make that trade-off with the resulting longer cycle time implied. The reason for resetting with a separate input is that the write circuit will only write "ones" into the memory. In the writing process, writing a "zero" is a null action having no effect, that is, do not write a "one". The reset input also has the advantage of quickly resetting all bits at the same time.

The chip of the illustrated embodiment is preferably CMOS including the analog circuitry that generates the correlation sum. The input $V_{dd}$ from the power supply may be 5 volts and $V_{ss}$, the ground potential, may be 0 volts. In some cases it will be desirable to design the chip for a +5 volt, −5 volt power input with zero ground. $V_{ref}$ is a reference voltage, preferably about 5 volts. The correlation output voltage is with reference to $V_{ref}$. If $V_{dd}$ is regulated well, then $V_{ref}$ can simply be connected to $V_{dd}$. Table II gives some of the chip specifications.

TABLE II

| | |
|---|---|
| $V_{dd}$ | 5 Volts |
| $V_{ss}$ | 0 Volts |
| $V_{ref}$ | 5 Volts |
| Max. Power Supply Current Per Chip | 15 milliamps |
| Typical Output Settling Time | 2 microseconds |
| Typical Comparator Delay | 1 microsecond |

The detailed structure of the correlator chip can best be understood by reference to the schematic diagram of FIG. 8. The correlator is preferably implemented using digital CMOS techniques. As previously explained, the weighted sum of all pixel values of the template is calculated in analog fashion using current summation. Each pixel whose pixel input is a match to the pixel's zero-one state bit outputs a current of magnitude proportional to its programmed weight. The instantaneous current values of the pixels are summed at a common node and pass through the correlation sum resistor. The correlation output (analog) is the voltage across that resistor, adjusted for the constant a.

The current output from each pixel current source comes from 1, 2, or 3 current sub-sources comprising saturated P-channel MOS transistors in parallel.

Referring to FIG. 8, a portion of a pixel summing source 120 in the summing source array 113 is provided with programming inputs 125 from row address decoder 115 and column address decoder 117 and it is provided with its respective parallel pixel input 127. An XOR circuit 141 receives pixel input 127 and the signal from memory bit B (zero-one response bit). The output of XOR circuit 141 is P. P=I XOR B. All transistors are turned off if I=B and P=0. If P=1 the number of transistors turned on is $W=W_1+W_2+W_3$. These all have identical gate voltages of $V_g$ applied from gate voltage control circuit 143 and identical source voltages of $V_{dd}$.

The current out of this pixel current source (i,j) is proportional to $P_{ij}W_{ij}$. Since the transistors are saturated, the current out of a source is substantially independent of the drain voltage and hence of the other pixels.

The current subsource 147 is the $W_3$ subsource. It is gated as follows. AND circuit 151 has inputs from the $W_3$ memory bit and the pixel P signal from XOR circuit 141. If both P and $W_3$ are 1 then the output from and circuit 151 is 1 and the voltage at the gate of transistor 122 is 5 volts. This turns on transistor 121 and turns off transistor 122. Gates of all transistors 155 of current subsource 147 are thus connected to $V_g$ providing four units of current output from current subsource 147.

If P or $W_3$ is 0, the voltage to the gate of transistor 122 is 0 turning on transistor 122 and turning off transistor 121 thereby setting the gate voltage of all transistors 155 to $V_{dd}$ and turning them off. The circuitry in the B, $W_1$, $W_2$, and $W_3$ cells of FIG. 9 is conventional and not shown in detail. It may include NOR latches which are reset to 0 when the "reset" line is high. Ones are written into the latch addresses by row and column decoders 115 and 117 in response to data from template programmer 19.

The operation of current subsource 157 is similar to that previously described for current subsource 147. Namely, AND circuit 161 is connected to produce an output to gate "on" transistors 165 through transistor 123 only when $W_2$ and P are both 1. Otherwise, current subsource 157 and transistors 165 are gated off by transistor 124. Invertors 153 and 163 cause transistors 123 and 121 to operate in the opposite sense of transistors 124 and 122.

The unit current subsource for current source 120 is not shown but will operate in the same manner responsive to memory bits $W_1$ and B as previously described for current subsources 157 and 147. Furthermore, the other pixel current sources in the pixel current source array 113 will be substantially identical and will operate differently only by virtue of different programming of memory bits $W_1$, $W_2$, $W_3$, and B.

The currents from all pixel current sources are collected on current bus 130 and directed to a node at summer 131 which, in this case, consists essentially of resistor 132 ($R_4$); quite apparently, the voltage at the analog output of correlation summer 131 is directly proportional to the current through resistor $R_4$. The same voltage is provided to input line 135 of comparator 133. The other input to comparator 133 is a downramp input signal generated in the ramp generator 53 of FIG. 1, for example. The same ramp input signal is provided to all templates of the correlation circuit. Thus, as previously explained, the first template in which the comparator 133 detects a ramp input voltage less than the correlation sum voltage will produce an output pulse identifying it as the template with the greatest correlation.

The previous explanation has been given as if it were possible to accurately know or control the resistances and transistor parameters of the circuit of FIG. 8. It will now be explained how the circuit operation is rendered accurate and reliable notwithstanding the fact that such parameter determination or control in an integrated circuit is not possible as a practical matter.

While it is a practical impossibility to fabricate precise resistors or transistors with precisely specified parameters on an integrated circuit chip, the relative values of resistors or transistors on one particular chip can be determined accurately. That is to say, two resistors on a chip can be determined to have equal resistances with a high degree of accuracy. Likewise, the characteristics of two transistors can be caused to be equal or have a predetermined relationship with a high degree of accuracy. In the apparatus of FIG. 8 a ratioing technique is used to make the correlation output accurate in spite of the inaccuracy of the resistances or other parameters of the circuit elements. This is done by properly setting $V_g$, the gate voltage supplied to all current source transistors throughout the template.

The gate voltage control circuit 143 automatically assures that the desired predetermined relationship exists between analog correlation output voltage at summer 131 and the $V_{ref}$ reference voltage for all templates of the entire circuit. Since the ramp voltage also is controlled relative to $V_{ref}$ the digital output of the current is accurate and reliable.

Referring now to FIG. 8 and the gate voltage control circuit 143 resistors $R_1$ and $R_2$ form a voltage divider which provides a voltage $V_r$ to an operational amplifier 171.

Since resistors can be ratioed accurately, $$V_r = V_{ref} R_2/(R1 = R2) \tag{6}$$

is subject to accurate determination.

The output of operational amplifier 171 connects to the gate of a block of parallel transistors 173. The transistor block 173 is the equivalent of 40 transistors and thus with the same gate voltage will produce essentially 40 times the current of a single transistor (assuming that it is saturated). The transistor block 173 in the $V_g$ control circuit is constructed as 40 parallel transistors, each identical to one of the current source transistors in the pixel array.

The output from transistors 173 is designated $i_3$ and passes through resistor $R_3$ to ground. The voltage at the ungrounded end of resistor $R_3$ is returned in a feedback loop to the other input of operational amplifier 171. Since the operational amplifier operates by negative feedback to equalize its two inputs by gating the transistors 173 and the current through $R_3$, the voltage across $R_3$ is equal to $V_r$. The current $i_3$ is equal to $V_r/R_3$ and is also equal to 40 times the current in a transistor of the current sources. Thus, each transistor in a current source in the pixel array has an on current $$I_{on} = 0.025 V_r/R_3. \tag{7}$$

The total current coming out of the current sources of the pixel array for the template is:

$$I_4 = \sum_{i=0}^{7} \sum_{j=0}^{5} P_{ij} W_{ij} I_{on} \tag{8}$$

The correlation output $V_c$ is therefore:

$$V_c + a + i_4 R_4 = a + .025\ V_r R_4/R_3 \sum_{i=0}^{7} \sum_{j=0}^{5} P_{ij} W_{ij} \tag{9}$$

The ratio $R_4/R_3$ can be accurately set to 1/25 and with $R_1 = R_2$, $V_r = \frac{1}{2} V_{ref} = 2.5$ volts. This gives:

$$0.025 V_r R_4/R_3 = 2.5 \times 10^{-3} \tag{10}$$

$$V_c = a + 2.5 \times 10^{-3} \sum_{i=0}^{7} \sum_{j=0}^{5} W_{ij} P_{ij} \tag{11}$$

Thus it will be seen that the gate voltage control circuit 143 causes the same gate voltage to be provided to all current source transistors of the template as is provided to the block of transistors 173 acting as a reference, and thus the effect of parameter variations common to all transistors on the chip is effectively cancelled out. In a similar manner, the effect of resistance variations common to all elements on the chip is cancelled out by ratioing the resistance values as described above.

Although the theory of operation of the circuit presented herein is believed to be correct and complete, the operation and utility of the circuit is not predicated on the theory of operation but is rather based on actual operation of apparatus made in accordance with principles of the invention.

In addition to the variations and modifications to the apparatus according to the invention which have been shown, described, or suggested, it will be apparent to those skilled in the art that other modifications and variations to the apparatus may be made within the scope of the invention, and, accordingly, the invention is not to be considered to be limited to those embodiments or variations shown or suggested, but it is rather to be determined by the reference to the appended claims.

APPENDIX A (1) Special Issue on Connectionist Models and Their Application, *Cognitive Science*, Vol. 9, ed. J. A. Feldman, 1985.

(2) J. A. Feldman and D. H. Ballard, "Connectionist Models and their Properties." *Cognitive Science*, Vol. 6, No. 3, Abex, Norwood, N.J. 1982, pp. 205–254.

(3) S. E. Fahlman and G. E. Hinton "Connectionist Architectures for Artificial Intelligence" *Computer* January 1987.

(4) F. Rosenblatt, *Principles of Neurodynamics*, Spartan Books, New York, N.Y. 1962.

(5) Douglas J. Granrath, "The Role of Human Visual Models in Image Processing," *Proc. of IEEE*, Vol. 69, No. 5, May 1981.

(6) D. H. Ballard, G. E. Hinton, and T. J. Sejnowski, "Parallel Visual Computation." *Nature*, Vol. 306, November 1983, pp. 21–26.

(7) T. N. Cornsweet, "Visual Perceptions," *Academic Press*, 1970.

(8) S. Geman and D. Geman, "Stochastic Relaxation, Gibbs Distributions, and the Bayesian Restoration of Images," *IEEE Trans. Pattern. Analysis and Machine Intelligence*, Vol. PAMI-6, No. 6, November 1984, pp. 721–741.

(9) J. J. Hopfield, "Neural Networks and Physical Systems with Emergent Collective Computational Abilities," *Proc. Nat. Academy of Sci.*, USA, 79, 2554–2558, 1982.

(10) J. J. Hopfield, "Neurons with Graded Response Have Collective Computational Properties Like Those of Two-State Neurons," *Proc. Nat. Academy of Sci.*, USA, 81, 3088–3092, 1984.

(11) J. J. Hopfield and D. W. Tank, "Neural Computation of Decisions in Optimization Problems," *Biological Cybernetics*, Vol. 52, No. 3, Springer-Verlag, New York, N.Y. 1985, pp. 141–152.

(12) J. J. Hopfield and D. W. Tank, "Computing with Neural Circuits: A Model", Science, Vol. 233, August 1986.

(13) M. Sivilotti, M. Emmerling, C. Mead, *Conference on Very Large Scale Integration*, H. Fuchs, editor, 1985.

(14) M. M. Nass and L. N. Cooper, "A Theory for the Development of Feature Detecting Cells in Visual Cortex," *Biological Cybernetics*, 19, 1975, pp. 1–18.

(15) D. S. Touretzky and G. E. Hinton, "Symbols Among the Neutrons: Details of a Connectionist Inference Architecture," *International Conference on Artificial Intelligence*, Vol. 3, August 1985.
(16) D. H. Hubel and T. N. Wiesel, "Receptive Fields, Binocular Vision, and Functional Architecture in the Cats Visual Cortex," *J. Physiology*, 160, 1962, pp. 105–154.
(17) D. L. Waltz, "Applications of the Connection Machine," *Computer*, January 1987.
(18) D. W. Tank and J. J. Hopfield, "Collective Computation in Neuron Like Circuits," *Scientific American*, December 1987.
(19) K. Fukushima, "Necognitron: A New Algorithm for Pattern Recognition Tolerant of Deformations," *Pattern Recognition* v15 1982.

What is claimed is:

1. In a hybrid digital-analog computer parallel processor having a multiplicity of digital inputs the improvement comprising:

(A) a plurality of template circuits, all the circuit elements of at least one complete template circuit being on a single integrated circuit chip, (B) each said template circuit including a multiplicity of controlled current sources each with a zero-one selectable control and a selectable fixed value current level control, said multiplicity of controlled current sources including:

(1) a voltage input from a reference, (2) a high gain differential amplifier with a plurality of inputs, (3) means for connecting a predetermined portion of said voltage input from a reference to a first of said inputs, (4) a block of parallel connected transistors on said chip, (5) a plurality of other transistors on said chip each having characteristics in common with each of said parallel connected transistors of said block, (6) means for connecting the output of said amplifier to all the gates of said transistors of said block, (7) a first resistor on said chip connected to conduct the combined current output of all said transistors of said block to ground, (8) means for connecting the voltage at the ungrounded end of said first resistor to a second of said inputs of said amplifier in a sense to cause variations in output of said amplifier applied to said gates to cause the difference of its inputs to approach zero, and (9) means for applying a gate voltage substantially equal to the output voltage of said amplifier to selected ones of said other transistors thereby causing the current produced by each of said other transistors to be equal to that of one of said transistors of said block or otherwise to be zero; and wherein said summer includes

(10) a second resistor on said chip having a resistance with a known ratio to the resistance of said first resistor,

(11) means for connecting the output currents of all said other transistors to pass through said second resistor to ground, and

(12) means for accessing the voltage at the ungrounded end of said second resistor.

(C) means for providing signals to select the status of said zero-one selectable control gates and said selectable fixed value current level controls.

(D) means for supplying each one of said multiplicity of digital inputs to the control gate of a corresponding one of said multiplicity of controlled current sources in all of said template circuits.

(E) each said template circuit further including a summer for algebraically summing the total current of all said controlled current sources of said template circuit.

(F) each said template circuit further including means for detecting when an algebraic sum of current flows exceeds an established value at a respective summer of (E), and for producing a digital signal in response thereto.

(G) means for registering the first N of said digital signals in the time sequence of said digital signals of (F) where N is at least one, and (H) means for generating a digital signal identifying at least the first one of said template circuits to have produced a digital signal of (F).

2. An analog computation current-summing integrated circuit chip implemented with circuit elements of unkown parameter values, comprising:

a high gain differential amplifier with a plurality of inputs, means for connecting a reference input voltage to a first of said inputs, a block of parallel connected transistors on said chip, a multiplicity of other transistors on said chip each having characteristics in common with each one of said parallel connected transistors of said block, means for connecting the output of said amplifier to gates of said transistors of said block, a first circuit element on said chip connected to receive the combined current output of all said transistors of said block, means for connecting the voltage of said first circuit element to a second of said inputs of said amplifier in a sense to cause variations in output of said amplifier applied to said gates to cause the difference of its inputs to approach zero, means for applying a gate voltage substantially equal to the output voltage of said amplifier to selected ones or groups of said other transistors thereby causing the current produced by each of said other transistors to be equivalent to that of one of said transistors of said block or otherwise to be zero, a second circuit element on said chip having a parameter value with a known ratio to the parameter value of said first circuit element, means for connecting said second circuit element to receive the output currents of all said other transistors, and means for accessing the voltage at said second circuit element.

3. Apparatus as recited in claim 2 further including a plurality of CMOS gating transistors for selecting certain of said other transistors to receive a gate voltage from said amplifier.

4. An analog computation current-summing integrated circuit chip implemented with circuit elements of unknown parameter values, comprising:

a voltage input from a reference, a high gain differential amplifier with a plurality of inputs, means for connecting a predetermined portion of said reference input voltage to a first of said inputs, a block of parallel connected transistors on said chip, a multiplicity of other transistors on said chip each having characteristics in common with each of said parallel connected transistors of said block, means for connecting the output of said amplifier to all the gates of said transistors of said block, a first resistor on said chip connected to conduct the combined current output of all said transistors of said block to ground, means for connecting the voltage at the ungrounded end of said first resistor to a second of said inputs of said amplifier in a sense to cause variations in output of said amplifier applied to said gates to cause the difference of its inputs to approach zero, means for applying a gate voltage substantially equal to the output voltage of said amplifier to selected ones of said other transistors thereby causing the current produced by each of said other transistors to be equal to that of one of said transistors of said block or otherwise to be zero, a second resistor on said chip having a resistance with a known ratio to the resistance of said first resistor, means for connecting the output currents of all said other transistors to pass through said second resistor to ground, and means for accessing the voltage at the ungrounded end of said second resistor.

5. Apparatus as recited in claim 4 further including a plurality of CMOS gating transistors for selecting certain of said other transistors to receive a gate voltage from said amplifier.

* * * * *